US005494487A

United States Patent [19]

Koike

[11] Patent Number: 5,494,487

[45] Date of Patent: Feb. 27, 1996

[54] METHOD FOR STABILIZING THE HYGRAL EXPANSION BEHAVIOR OF PROTEIN FIBER PRODUCTS

[75] Inventor: Sachizumi Koike, Aichi, Japan

[73] Assignee: Tuyaku Co., Ltd., Aichi, Japan

[21] Appl. No.: 204,254

[22] Filed: Mar. 7, 1994

[30] Foreign Application Priority Data

Jul. 17, 1992 [JP] Japan ..... 4-213713

[51] Int. Cl.[6] ..... D06M 13/11; D06M 101/12

[52] U.S. Cl. ..... 8/127.6; 8/128.1; 8/128.3; 8/127.5; 252/8.8; 252/8.9

[58] Field of Search ..... 8/128.1, 128.3, 8/127.5, 127.6; 252/8.8, 8.9; 427/389

[56] References Cited

U.S. PATENT DOCUMENTS 2,829,071 4/1958 Schroeder ..... 8/128.1

FOREIGN PATENT DOCUMENTS 46-9426 3/1971 Japan .
50-31194 3/1975 Japan .
52-987 1/1977 Japan .
64-20380 1/1989 Japan ..... 8/128.1
1-266276 10/1989 Japan .
1-266276 10/1989 Japan .
2-216269 8/1990 Japan ..... 8/128.1
3-45780 2/1991 Japan .

*Primary Examiner*—Prince Willis, Jr.
*Assistant Examiner*—Alan D. Diamond
*Attorney, Agent, or Firm*—McAulay Fisher Nissen Goldberg & Kiel

[57] ABSTRACT

Disclosed is a method comprising: a step in which a polyoxirane derivative of PEGDE or PPGDE having a water-dissolving rate of not less than 95 % by weight is dissolved in a solvent which has a solubility parameter of 13.0–10.1 $(cal/cm^3)^{1/2}$, has a boiling point in a range of 101°–190° C. and is freely soluble in water, so as to provide a water-soluble solution; a step in which the water-soluble solution is added with an aqueous solution containing at least two or more species of catalysts for oxirane compounds selected from the group consisting of dicyandiamide, hydroxy carboxylic acid salts, thiocyanate and L-cysteines so as to prepare a treatment solution; a step in which a protein fiber product is immersed in the treatment solution followed by dehydration; a step in which the dehydrated protein fiber product is subjected to a heat treatment so as to make a cross-linking reaction of the polyoxirane derivative with the protein fiber product; and a step in which by-products are removed from the heat-treated protein fiber product. The hygral expansion behavior of the protein fiber product is stabilized more surely without deteriorating its feeling, and the scarcely water-soluble by-products generated by the heat treatment are removed.

7 Claims, No Drawings

METHOD FOR STABILIZING THE HYGRAL EXPANSION BEHAVIOR OF PROTEIN FIBER PRODUCTS

This application is a 371 of PCT/JP93/01005 filed 7/19/93.

TECHNICAL FIELD

The present invention relates to a method for stabilizing the hygral expansion behavior of protein fiber products without deteriorating flexible feeling.

BACKGROUND ART

It is known that protein fiber products such as wool products cause a so-called hygral expansion phenomenon in which the length of a fiber product expands and contracts depending on difference in water-containing rate even when relaxation shrinkage is completely removed. Resulting from this phenomenon, there has been such an inconvenience that when the temperature and humidity of an atmosphere in which the protein fiber product is placed change, the size of the fiber product is not stabilized, and when the fiber product is woolen fabric, deficiency in quality is caused such as puckering, bubbling, non-uniform sizes and the like.

In the prior art, in order to stabilize the hygral expansion behavior, the fiber product is subjected to a water repellent treatment, the fiber product is subjected to a water repellent treatment followed by a baking treatment, or the fiber product is subjected to a treatment using a thiol derivative followed by an oxidation treatment. However, the stabilization effect on the hygral expansion is not sufficient even by these treatment methods, in which there has been a room to make improvement yet.

As a method for improving such a point, a method for stabilizing the hygral expansion behavior of high grade woolen fabric has been proposed in which ethylene glycol diglycidyl ether (hereinafter referred to as EGDE) or propylene glycol diglycidyl ether (hereinafter referred to as PGDE) is used as a main agent, and polyvalent carboxylic acid or its salt is used as a catalyst thereof (Japanese Patent Laid-open No. 55-36343).

In this stabilization method, the woolen fabric is immersed in a weakly acidic treatment solution comprising the above-mentioned EGDE or PGDE and the above-mentioned catalyst, squeezed, and preliminarily dried, followed by a heat treatment at 150° C., so as to suppress the behavior in which crimping of yarn is increased or reduced depending on a degree of hygroscopic absorption or evaporation of moisture.

However, in the above-mentioned stabilization method, EGDE or PGDE is made into a water-soluble solution using a solvent of isopropyl alcohol having a solubility parameter of 1.15 $(cal/cm^3)^{1/2}$ and a boiling point of not more than 100° C., so that in the prepared treatment solution, a reaction amount with the woolen fabric is not so large, and this solvent film disappears upon a heat treatment at 150° C. In addition, the polyvalent carboxylic acid or its salt (for example, monosodium citric acid salt), which is used as the catalyst for reacting the above-mentioned EGDE or PGDE with the woolen fabric, does not have a fast reaction speed, a cross-linked structure obtained by the reaction under this catalyst is poor in durability against hydrolysis, and consequently the stabilization effect on the hygral expansion has not been so high. In addition, in the case of the above-mentioned stabilization method, the emulsifying agent comprising EGDE or PGDE remains in the woolen fabric, so that there has been such an inconvenience that the water repellent performance of the woolen fabric is reduced.

An object of the present invention is to provide a method in which the hygral expansion behavior of protein fiber products is stabilized more surely without deteriorating flexible feeling.

Another object of the present invention is to provide a method for stabilizing the hygral expansion behavior in which scarcely water-soluble by-products generated by a heat treatment of protein fiber products are removed so as to make it possible to improve the quality of the protein fiber products.

DISCLOSURE OF THE INVENTION

In order to achieve the above-mentioned objects, the method for stabilizing the hygral expansion behavior of protein fiber products of the present invention resides in a method comprising: a step in which a polyoxirane derivative having a water-dissolving rate of not less than 95% by weight is dissolved in a solvent which has a solubility parameter of 13.0–10.1 $(cal/cm^3)^{1/2}$, has a boiling point in a range of 101°–190° C. and is freely soluble in water, so as to provide a water-soluble solution; a step in which the solution is added with an aqueous solution containing at least two or more species of catalysts for oxirane compounds selected from the group consisting of dicyandiamide, hydroxy carboxylic acid salts, thiocyanate and L-cysteines so as to prepare a treatment solution; a step in which a protein fiber product is immersed in the above-mentioned treatment solution followed by dehydration; a step in which the dehydrated protein fiber product is subjected to a heat treatment so as to make a cross-linking reaction of the polyoxirane derivative with the protein fiber product; and a step in which by-products are removed from the heat-treated protein fiber product.

The polyoxirane derivative is an ethylene or polyethylene glycol diglycidyl ether derivative (hereinafter referred to as PEGDE) represented by the following formula (1), or a propylene or polypropylene glycol diglycidyl ether derivative (hereinafter referred to as PPGDE) represented by the following formula (2):

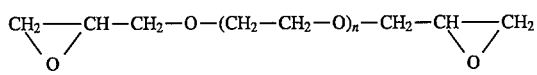

(1)

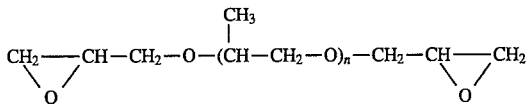

(2)

(In the formulae (1) and (2), there is given n=1–4.)

The present invention will be explained in detail hereinafter.

(a) Protein Fiber Product

The protein fiber product of the present invention is animal hair fiber such as wool, cashmere, alpaca or the like, cocoon fiber obtained from cocoons of domestic silkworm, wild silkworm or the like, or woolen yarn or silk yarn produced from these fibers, or fabric, knitted goods or nonwoven fabric produced from these fibers or yarns. The protein fiber product also includes textile blend products, union fabric products and union knitted products with other natural fiber or chemical fiber.

(b) Polyoxirane Type Derivative

The polyoxirane derivative of the present invention is PEGDE represented by the formula (1) or PPGDE represented by the formula (2). PEGDE or PPGDE has an addition mole number of ethylene glycol or propylene glycol which is in a range of 1–4 respectively, and has a water-dissolving rate of not less than 95% by weight.

PEGDE or PPGDE is applied to the protein fiber product by 2.5–25% by weight, preferably 5–15% by weight. If it is less than 2.5% by weight, there is no contribution to the stabilization of the hygral expansion, while if it exceeds 25% by weight, the feeling of the protein fiber product is apt to become rough and hard.

In addition to PEGDE or PPGDE, the polyoxirane derivative may be allowed to further include one species or two or more species of derivatives having a water-dissolving rate of not less than 95% by weight selected from the group consisting of a polyglycerol polyglycidyl ether derivative (hereinafter referred to as PGPDE), a glycerol polyglycidyl ether derivative (hereinafter referred to as GPGDE), and glycerol glycidyl represented by the following formula (3). By allowing them to be included, the flexibility of the protein fiber product is further improved.

The using amount thereof is 15–50% by weight, preferably 20–35% by weight with respect to PEGDE or PPGDE. If it is less than 15% by weight, the co-existing effect is poor, while if it exceeds 50% by weight, there is no contribution to the stabilization of the hygral expansion.

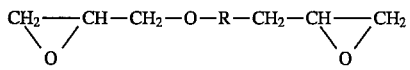

(3)

(In the above-mentioned formula (3), R is:

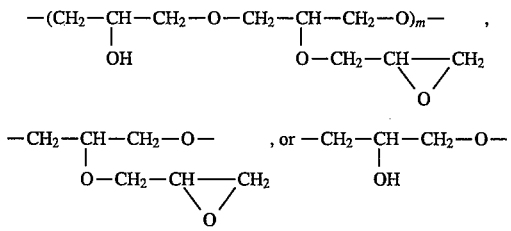

wherein there is given m=1–3.)

(c) Preparation of the Water-Soluble Solution of the Polyoxirane Derivative

Some of the polyoxirane derivatives are not completely soluble in water, so that they are made into water-soluble solutions using predetermined solvents.

Such a solvent is the solvent which has a solubility parameter of 13.0–10.1 $(cal/cm^3)^{1/2}$, has a boiling point in a range of 101°– 190° C., and is freely soluble in water. As exemplification of the solvent are exemplified N,N-dimethyl-formamide, 1,4-dioxane, dimethyl sulfoxide and the like. These solvents may be used alone, or in combination of two or more species. Provided that the solvent can be used to prepare a stable aqueous solution of the polyoxirane derivative without using an emulsifying agent in the presence of water, there is no limitation to the exemplified solvents. Among them, non-protonic solvents are preferable because they stabilize the solution of the polyoxirane derivative, and are suitable for the reaction between the protein fiber product and the polyoxirane derivative in the aqueous system.

(d) Catalyst for Oxirane Compounds

The catalyst for oxirane compounds of the present invention is used by combining at least two or more species of catalysts selected from the group consisting of (1) dicyandiamide, (2) hydroxy carboxylic acid salts, (3) thiocyanate and (4) L-cysteines. Among the combinations, when L-cysteines of the above-mentioned (4) are included, the reaction is sufficiently facilitated, which is preferable. Incidentally, in the present specification, "L-cysteines" refer not only to L-cysteine but also to those containing derivatives of L-cysteine in addition thereto. In addition, when the three species of the catalysts of the above-mentioned (1), (2) and (3) are used together, it is needless to especially use L-cysteines of the above-mentioned (4). Incidentally, when any one of the catalysts of the above-mentioned (1)–(4) is used alone, the feeling of the protein fiber product becomes rough and hard, which is not preferable.

As exemplification of the hydroxy carboxylic acid salts of (2) are exemplified alkaline metal salts of those of the aliphatic type such as citric acid, gluconic acid, lactic acid, malic acid, tartaric acid and the like. Among them, potassium salts, especially tripotassium citrate, are preferable. As exemplification of the thiocyanate of (3) are exemplified alkaline metal salts of thiocyanic acid, and among them, potassium salts are preferable.

Further, as exemplification of L-cysteines of (4) are exemplified L-cysteine, hydrate of hydrochloric acid salt of L-cysteine and N-acetyl-L-cysteine. Incidentally, when L-cysteine and hydrate of hydrochloric acid salt of L-cysteine are oxidized, they deposit as L-cystine and do not make a stable aqueous solution, so that it is necessary to allow a large amount of N-acetyl-L-cysteine to co-exit during the use.

The aqueous solution containing the catalyst for oxirane compounds contains 1–15.7% by weight of dicyandiamide (preferably 3–8% by weight), 0.8–12.5% by weight of hydroxy carboxylic acid salts (preferably 0.8–5% by weight), 0.75–11.8% by weight of thiocyanate (preferably 0.75–5% by weight), and 0.5–12% by weight of L-cysteines (preferably 0.5–1.6% by weight) provided that the aqueous solution is 100% by weight.

Incidentally, L-cysteines are preferably a composition in which 30% by weight of L-cysteine, 10% by weight of hydrate of hydrochloric acid salt of L-cysteine and 60% by weight of N-acetyl-L-cysteine are blended, and from a viewpoint of stability, it is preferable to use N-acetyl-L-cysteine alone. In addition, from an economical viewpoint, a composition is preferable in which 60–70% by weight of N-acetyl-L-cysteine and 40–30% by weight of L-cysteine are blended.

(e) Preparation of the Treatment Solution for the Protein Fiber Product

The treatment solution for the protein fiber product is prepared by adding the aqueous solution containing the catalyst for oxirane compounds of the above-mentioned (d) to the water-soluble solution of the polyoxirane derivative of the above-mentioned (c). At this time, with respect to 100% by weight of the polyoxirane derivative, 10–62.5% by weight of the catalyst for oxirane compounds is added. If it is less than 10% by weight, the reaction is not facilitated sufficiently, while if it exceeds 62.5% by weight, contribution is made to stabilization of the hygral expansion, however, a range capable of practical use of the protein fiber product is exceeded in relation to the feeling.

(f) Immersion of the Protein Fiber Product in the Treatment Solution and Dehydration The above-mentioned treatment solution is stored in a predetermined liquid tank, and the protein fiber product is immersed in this treatment solution, squeezed and dehydrated by means of a padding mangle or the like. In order to further ensure impregnation with the treatment solution, it is preferable to repeat the immersion and dehydration twice.

Herein, it is preferable that the protein fiber product is immersed in the treatment solution at a time point of completion of washing in the case of fiber or yarn dyed products or gray fabric products, or at a time point of completion of dyeing in the case of piece dyeing products.

(g) Heat Treatment of the Dehydrated Protein Fiber Product

This heat treatment includes two types, that is a wet type and a dry type. The dry type heat treatment is performed by immersing the dehydrated protein fiber product in hot water at a temperature of 80°–100° C. for 40–20 minutes, or by allowing superheated steam to pass through the protein fiber product followed by drying it. In addition, in the dry type heat treatment, the dehydrated protein fiber product is preliminarily dried at a temperature of 80°–100° C. for 30–10 minutes, followed by baking at a temperature of 120°–165° C. for 20–1 minutes. The temperature during the heat treatment depends on the boiling point of the solvent described in the above-mentioned (c). When the heat treatment is performed at a temperature which is lower than the boiling point of the solvent used by 10°–15° C., the solvent of the present invention has its boiling point which is higher than the boiling point of water, so that water decreases due to evaporation, and a solvent film containing the polyoxirane derivative and the catalyst is allowed to exist on the protein fiber product.

Owing to this heat treatment, the polyoxirane derivative having a predetermined molecular length makes a cross-linking reaction with each fiber of the protein fiber product, resulting in a fiber structure having strong hydrolysis resistance.

(h) Removal of By-Products from the Protein Fiber Product

In the above-mentioned cross-linking reaction, when L-cysteines are included as the catalyst for oxirane compounds, L-cysteine and hydrate of hydrochloric acid salt of L-cysteine are oxidized. Such an oxide becomes a white crystalline substance of L-cystine scarcely soluble in water, which deposits on the surface of the protein fiber product, and deteriorates quality of the fiber product. In order to remove the oxide, the protein fiber product after the heat treatment is washed with a polar solvent. As this polar solvent is used low molecular weight alcohol freely soluble in water such as methanol, ethanol and the like having a dissolving ability with respect to L-cystine.

As one example, an aqueous solution of 2–10% by weight of isopropyl alcohol is prepared, and the protein fiber product after the heat treatment is repeatedly immersed in the aqueous solution to perform washing and dehydration. Owing to this washing, in addition to removal of L-cystine as a main by-product, when the solvent having the high boiling point described in the above-mentioned (c) or L-cysteines described in the above-mentioned (d) remain unreacted respectively, these remaining matters are also removed.

When the protein fiber product impregnated with the above-mentioned treatment solution is subjected to the heat treatment, the catalyst serves to make the cross-linking reaction of the polyoxirane derivative with the protein fiber product taking precedence over an inter-solution reaction. The polyoxirane derivative has a predetermined molecular length, so that it suitably reacts with each fiber of the protein fiber product, and makes the protein fiber product to have a fiber structure with strong hydrolysis resistance.

When the protein fiber product after the heat treatment is washed with the polar solvent, the remaining high boiling point solvent and unreacted L-cysteines are removed. Thereby thiol derivatives, which serve as a cause of an exchange reaction between thiol groups (SH groups) and cystine bonds (—S—S—) of polypeptide chains of the protein fiber product, can be removed, and the hygral expansion can be further stabilized.

BEST MODE FOR CARRYING OUT THE INVENTION

Next, Examples of the present invention will be explained together with Comparative Examples. Examples shown herein are only by way of example, which do not limit the technical scope of the present invention.

Preparation of Treatment Solutions (1) As the polyoxirane derivative of the PEGDE type were used those made by Nagase Chemicals Co., Ltd. having trade names of Denacol EX-850 (n=2), Denacol EX-810 (n=1), Denacol EX-821 (n=about 4), Denacol EX-830 (n=9) and Denacol EX-841 (n=about 13).

(2) As the polyoxirane derivative of the PPGDE type was used one made by Nagase Chemicals Co., Ltd. having a trade name of Denacol EX-920 (n=3).

(3) As the polyoxirane derivative of the PGPDE type was used one made by Nagase Chemicals Co., Ltd. having a trade name of Denacol EX-521 (m=about 3).

(4) As the polyoxirane derivative of the GPGDE type was used one made by Nagase Chemicals Co., Ltd. having a trade name of Denacol EX-313.

Each of the polyoxirane type derivatives of the above-mentioned (1)–(4) was dissolved in dimethyl sulfoxide, and a water-soluble dimethyl sulfoxide solution containing 30% by weight of the polyoxirane derivative was prepared. Incidentally, n or m in the parentheses of the above-mentioned (1)–(4) is an addition mole number in the above-mentioned formula (1) to the formula (3).

(5) Polyoxirane derivatives, in which 28% by weight of the above-mentioned Denacol EX-850 and 2% by weight of the above-mentioned Denacol EX-810 belonging to the PEGDE type respectively and 10% by weight of the Denacol EX-313 of the GPGDE type were uniformly mixed, were dissolved in 1,4-dioxane, and a water-soluble 1,4-dioxane solution containing 40% by weight of the polyoxirane derivatives was prepared (hereinafter referred to as HG-15).

Next, aqueous solutions containing the following four kinds of catalysts for oxirane compounds were prepared.

(6) An aqueous solution was prepared containing 21% by weight in total of three kinds of catalysts of 1% by weight of dicyandiamide, 10% by weight of tripotassium citrate and 10% by weight of potassium thiocyanate (hereinafter referred to as Cat-1).

(7) An aqueous solution was prepared containing 10% by weight in total of a catalyst comprising only L-cysteines of 6% by weight of N-acetyl-L-cysteine, 3% by weight of L-cysteine and 1% by weight of hydrate of hydrochloric acid salt of L-cysteine (hereinafter referred to as Cat-2).

(8) An aqueous solution was prepared in which 62.5% by weight of the above-mentioned Cat-1 and 37.5% by weight of Cat-2 were uniformly mixed (hereinafter referred to as Cat-3).

(9) An aqueous solution was prepared in which 7.5% by weight of dicyandiamide, 40% by weight of the above-mentioned Cat-2, 40% by weight of N,N-dimethyl-formamide and 12.5% by weight of water were uniformly mixed (hereinafter referred to as Cat-4).

EXAMPLE 1

A gray woolen fabric of a satin weave structure of five warps per unit having a weight per square meter of 220 g/m$^2$, which was woven using worsted yarn of a yarn count of 2/60 meter as warp, and using worsted yarn of a yarn count of 1/60 meters as weft, to have a warp density of 48 individuals/cm and a weft density of 38 individuals/cm, was prepared.

After this woolen fabric was dyed and dried, it was individually immersed in four kinds of treatment solutions shown in Table 1 respectively, and squeezed using a padding mangle with two rolls, so as to uniformly impregnate the treatment solutions into the woolen fabric at a pick-up rate of 90% by weight.

The heat treatment was performed in accordance with a dry type method. Namely, the above-mentioned woolen fabric was preliminarily dried at 100T for 5 minutes, followed by baking at 165° C. for 1 minute. Next, the heat-treated woolen fabric was washed with hot water for 5 minutes using an aqueous solution of 2% by weight of isopropyl alcohol at 30° C., followed by dehydration and drying. The obtained woolen fabric was used as a test cloth.

The treatment solutions shown in Table 1 are those in which all of the polyoxirane derivatives were of the PEGDE type adapted to the formula (1) or the formula (2), and the catalysts of three or more species were used as the catalyst for oxirane compounds, so that all of them fall under the present invention.

TABLE 1

| | Treatment solution | | | |
|---|---|---|---|---|
| | 1 | 2 | 3 | 4 |
| PEGDE (EX-810) | 30 | — | 30 | — |
| PEGDE (EX-850) | — | 30 | — | 30 |
| Cat-1 | 10 | 10 | — | — |
| Cat-3 | — | — | 15 | 15 |

(unit: % by weight)

COMPARATIVE EXAMPLE 1

A dyed woolen fabric of the same kind as that in Example 1 was individually immersed in six kinds of treatment solutions shown in Table 2 respectively, and thereafter test cloths were obtained in the same manner as Example 1. In the treatment solutions shown in Table 2, the polyoxirane derivatives were those of the PEGDE type, PGPDE type and GPGDE type, and three or more species of catalysts were used as the catalyst for oxirane compounds. However, all of the treatment solutions do not fall under the present invention because EX-841 of the PEGDE type in the treatment solution 5 has an addition mole number of about 13. and because the polyoxirane derivatives of EX-521 of the PGPDE type or EX-313 of the GPGDE type have small reaction amounts in the case of using them alone, respectively.

TABLE 2

| | Treatment solution | | | | | |
|---|---|---|---|---|---|---|
| | 5 | 6 | 7 | 8 | 9 | 10 |
| PEGDE (EX-841) | 30 | — | — | 30 | — | — |
| PGPDE (EX-521) | — | 30 | — | — | 30 | — |
| GPGDE (EX-313) | — | — | 30 | — | — | 30 |
| Cat-1 | 10 | 10 | 10 | — | — | — |

TABLE 2-continued

| | Treatment solution | | | | | |
|---|---|---|---|---|---|---|
| | 5 | 6 | 7 | 8 | 9 | 10 |
| Cat-3 | — | — | — | 15 | 15 | 15 |

(unit: % by weight)

COMPARATIVE EXAMPLE 2

A dyed woolen fabric of the same kind as that in Example 1 was individually immersed in six kinds of treatment solutions shown in Table 3 respectively, and thereafter test cloths were obtained in the same manner as Example 1.

In the treatment solutions shown in Table 3, the polyoxirane derivatives were those of the PEGDE type, PGPDE type and GPGDE type, and one species of catalyst was used as the catalyst for oxirane compounds. The case in which the catalyst is only one species does not fall under the present invention.

TABLE 3

| | Treatment solution | | | | |
|---|---|---|---|---|---|
| | 11 | 12 | 13 | 14 | 15 |
| PEGDE (EX-810) | 30 | — | — | — | — |
| PEGDE (EX-850) | — | 30 | — | — | — |
| GEGDE (EX-841) | — | — | 30 | — | — |
| PGPDE (EX-521) | — | — | — | 30 | — |
| GPGDE (EX-313) | — | — | — | — | 30 |
| Cat-2 | 5 | 5 | 5 | 5 | 5 |

(unit: % by weight)

EXAMPLE 2

A gray woolen fabric of a gabardine structure of ⅓ of a weight per square meter of 250 g/m$^2$ which was woven using worsted yarn of a yarn count of 2/56 meters as warp, and using worsted yarn of a yarn count of 2/48 meters as weft, to have a warp density of 46 individuals/cm and a weft density of 25 individuals/cm, was prepared. After this gray fabric was dyed and dried, it was individually immersed in four kinds of treatment solutions shown in Table 4 respectively, and thereafter test cloths were obtained by the treatment in the same manner as Example 1.

In the treatment solutions shown in Table 4, the polyoxirane derivatives were those of the PPGDE type and the PEGDE type, and three or more species of catalysts were used as the catalyst for oxirane compounds, so that all of them fall under the present invention.

TABLE 4

| | Treatment solution | | | |
|---|---|---|---|---|
| | 16 | 17 | 18 | 19 |
| PPGDE (EX-920) | 30 | — | 30 | — |
| PEGDE (EX-821) | — | 30 | — | 30 |
| Cat-1 | 10 | 10 | — | — |
| Cat-3 | — | — | 15 | 15 |

(unit: % by weight)

EXAMPLE 3

A gray woolen fabric of a satin weave structure of five warps per unit having a weight per square meter of 250 g/m$^2$, which was woven using worsted yarn of a yarn count of 2/48 meters as warp, and using mohair yarn of a yarn count of 1/32 meters as weft, to have a warp density of 38 individuals/cm and a weft density of 24 individuals/cm, was prepared. After this gray fabric was dyed and dried, it was individually immersed in four kinds of treatment solutions shown in Table 4 respectively in the same manner as Example 2, and thereafter test cloths were obtained by the treatment in the same manner as Example 1.

EXAMPLE 4

A gray woolen fabric of a satin weave structure of five warps per unit having a weight per square meter of 260 g/m$^2$, which was woven using worsted yarn of a yarn count of 2/60 meters as warp, and using worsted yarn of a yarn count of 1/40 meters as weft, to have a warp density of 52 individuals/cm and a weft density of 36 individuals/cm, was prepared. After this gray fabric was dyed and dried, it was individually immersed in five kinds of treatment solutions-:shown in Table 5 respectively, and thereafter test cloths were obtained by the treatment in the same, manner as Example 1.

In the treatment solutions shown in Table 5, the polyoxirane derivatives reside in the composition in which the PEGDE type and the GPGDE type were mixed, and two or more species of catalysts were used as the catalyst for oxirane compounds, so that all of them fall under the present invention.

TABLE 5

| | Treatment solution | | | | |
|---|---|---|---|---|---|
| | 20 | 21 | 22 | 23 | 24 |
| Mixture of PEGDE and GPGDE (HG-15) | 40 | 30 | 20 | 10 | 30 |
| Cat-3 | 10 | 8 | 8 | 8 | — |
| Cat-4 | — | — | — | — | 30 |

(unit: % by weight)

EVALUATION TEST

With respect to 28 kinds of the test cloths obtained in Example 1, Comparative Example 1, Comparative Example 2, Example 2, Example 3 and Example 4, a hygral expansion test, feeling measurement and appearance examination were performed.

(I) Hygral Expansion Test

The test was performed in accordance with a conventional method of the hygral expansion test established by I.W.S. (International Wool Secretariat). Namely, a test cloth of about 25 cm×25 cm was spotted with marks at warp and weft intervals of 20 cm, this test cloth was immersed in an aqueous solution at 70° C. containing 0.1% of a nonionic surface active agent for 30 minutes without folding it, and the aqueous solution was sufficiently impregnated. Next, the test cloth was taken out, interposed between dry cloths and pressed so as to remove water, and thereafter a length between the marks (hereinafter referred to as Lw) was measured. Next, the test cloth was dried at 80° C. for not less than 4 hours, and thereafter a length between the marks (hereinafter referred to as Ld) was measured again. The value of the hygral expansion (hereinafter referred to as HG (%)) is represented by the following equation (4):

$$HG\ (\%)=\{(Lw-Ld)/Ld\}\times 100 \quad (4)$$

Values of HG (%) of the 28 kinds are shown in Table 6 and Table 7.

(II) Feeling Measurement

An organoleptic test was performed by means of handling by a skilled person who had been engaged in the feeling measurement for woolen fabric for many years, and evaluation of the following three degrees was made for the test cloths of 28 kinds. Results are shown in Table 6 and Table 7.

In Table 6 and Table 7, ++ means extremely good, + means ordinary, and ± means deficient.

(III) Presence or Absence of By-Products

Appearances of the test cloths of 28 kinds were examined by visual observation, and the presence or absence of existence of by-products on each surface was confirmed.

TABLE 6

| | HG (%) | | |
|---|---|---|---|
| | Warp direction | Weft direction | Feeling |
| Untreated cloth | 9.1 | 5.1 | ++ |
| Example 1 | | | |
| Treatment solution 1 | 8.4 | 4.2 | ++ |
| Treatment solution 2 | 6.6 | 3.4 | ++ |
| Treatment solution 3 | 8.0 | 3.8 | ++ |
| Treatment solution 4 | 6.3 | 3.1 | ++ |
| Comparative Example 1 | | | |
| Treatment solution 5 | 10.2 | 6.3 | ++ |
| Treatment solution 6 | 11.1 | 4.1 | + |
| Treatment solution 7 | 11.2 | 6.3 | ++ |
| Treatment solution 8 | 10.1 | 6.1 | ++ |
| Treatment solution 9 | 11.0 | 5.1 | + |
| Treatment solution 10 | 11.0 | 6.0 | ++ |
| Comparative Example 2 | | | |
| Treatment solution 11 | 9.5 | 5.4 | ++ |
| Treatment solution 12 | 9.2 | 5.2 | ++ |
| Treatment solution 13 | 11.5 | 6.4 | ++ |
| Treatment solution 14 | 11.0 | 6.0 | + |
| Treatment solution 15 | 11.2 | 6.3 | ++ |

TABLE 7

| | HG (%) | | |
|---|---|---|---|
| | Warp direction | Weft direction | Feeling |
| Untreated cloth | 7.1 | 6.3 | ++ |
| Example 2 | | | |
| Treatment solution 16 | 5.6 | 6.3 | ++ |
| Treatment solution 17 | 6.1 | 5.2 | ++ |
| Treatment solution 18 | 5.1 | 6.3 | ++ |
| Treatment solution 19 | 5.0 | 4.1 | ++ |
| Untreated cloth | 4.5 | 5.3 | ++ |
| Example 3 | | | |
| Treatment solution 16 | 4.1 | 4.2 | + |
| Treatment solution 17 | 3.3 | 3.1 | ++ |
| Treatment solution 18 | 3.8 | 3.6 | + |
| Treatment solution 19 | 2.9 | 3.1 | ++ |
| Untreated cloth | 9.9 | 5.2 | ++ |
| Example 4 | | | |
| Treatment solution 20 | 5.2 | 2.6 | ++ |
| Treatment solution 21 | 6.5 | 3.6 | ++ |
| Treatment solution 22 | 6.7 | 3.6 | ++ |
| Treatment solution 23 | 8.3 | 4.1 | ++ |
| Treatment solution 24 | 4.1 | 3.1 | ++ |

According to the results in Table 6 and Table 7, it was found that the protein fiber products treated with the treatment solutions falling under the present invention had values of the hygral expansion which were smaller than those of the untreated cloths, in which the hygral expansion was stabilized.

In addition, the feeling thereof was "extremely good" for all of them except for the treatment solutions 16 and 18 in Example 3 which were "ordinary".

Further, as a result of appearance examination by visual observation of the test cloths, no by-product such as a deposited matter or the like was found on all of the test cloths.

INDUSTRIAL APPLICABILITY

The method of the present invention stabilizes the hygral expansion behavior of protein fiber products more surely without deteriorating flexible feeling.

I claim:

1. A method for stabilizing the hygral expansion behavior of protein fiber products comprising:

dissolving a polyoxirane derivative having a water-dissolving rate of not less than 95% by weight in a solvent which has a solubility parameter of 10.1 to 13.0 $(cal/cm^3)^{1/2}$, a boiling point in a range of 101°–190° C., and is freely soluble in water, so as to provide a water-soluble solution;

adding the water-soluble solution to an aqueous solution containing catalyst for oxirane compounds comprising 1–15.7% by weight of dicyandiamide, 0.8–12.5% by weight of hydroxy carboxylic acid salts, 0.75–11.8% by weight of thiocyanate, and 0.5–12% by weight of L-cysteines based on 100% by weight of the aqueous solution to prepare a treatment solution;

immersing a protein fiber product in the treatment solution and then dehydrating the fiber product;

subjecting the dehydrated protein fiber product to a heat treatment to cross-link the polyoxirane derivative with the protein fiber product and produce L-cystine by-products; and removing L-cystine by-products from the heat-treated protein fiber product;

wherein the polyoxirane derivative is an ethylene or polyethylene glycol diglycidyl ether derivative represented by formula (1), or a propylene or polypropylene glycol diglycidyl ether derivative represented by formula (2);

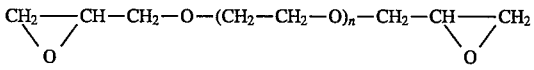

(1)

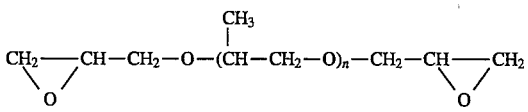

(2)

wherein in formulae (1) and (2) n=1–4.

2. The method for stabilizing the hygral expansion behavior of protein fiber products according to claim 1 wherein in addition to the ethylene or polyethylene glycol diglycidyl ether derivative or the propylene or polypropylene glycol diglycidyl ether derivative as defined in claim 1, the polyoxirane derivative further comprises at least one of derivatives having a water-dissolving rate of not less than 95% by weight selected from the group consisting of a polyglycerol polyglycidyl ether derivative, a glycerol polyglycidyl ether derivative, and a glycerol glycidyl derivative represented by the following formula (3):

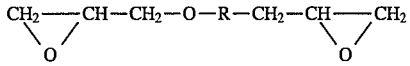

(3)

wherein in formula (3), R is:

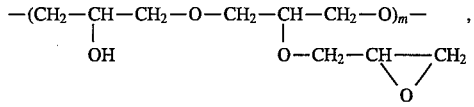

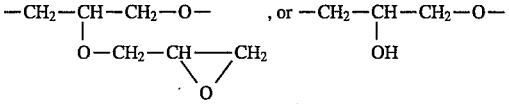

wherein m=1–3.

3. The method for stabilizing the hygral expansion behavior of protein fiber products according to claim 1 wherein 10– 62.5% by weight of the catalyst for oxirane compounds is added with respect to 100% by weight of the polyoxirane derivative.

4. The method for stabilizing the hygral expansion behavior of protein fiber products according to claim 1 wherein the heat treatment of the dehydrated protein fiber product is performed by a treatment in hot water at a temperature of 80°–100° C. for 20–40 minutes or a steam heat treatment, followed by drying.

5. The method for stabilizing the hygral expansion behavior of protein fiber products according to claim 1 wherein the heat treatment of the dehydrated protein fiber product is performed by preliminarily drying at a temperature of 80°–100° C., followed by baking at a temperature of 120°–165° C. for 1–20 minutes.

6. The method for stabilizing the hygral expansion behavior of protein fiber products according to claim 1 wherein the removal of by-products from the protein fiber product is performed by washing the protein fiber product with an aqueous solution at a temperature of 19°–40° C. containing a polar solvent which has the ability to dissolve L-cystine.

7. The method for stabilizing the hygral expansion behavior of protein fiber products according to claim 2 wherein 10–62.5% by weight of the catalyst for oxirane compounds is added with respect to 100% by weight of the polyoxirane derivative.

* * * * *